US005626373A

United States Patent [19]

Chambers et al.

[11] Patent Number: 5,626,373

[45] Date of Patent: May 6, 1997

[54] DRAW LATCH ASSEMBLY

[75] Inventors: William M. Chambers, Valley City; Mark S. Coats, Warrensville Hts., both of Ohio

[73] Assignee: The Lamson & Sessions Co., Cleveland, Ohio

[21] Appl. No.: 503,928

[22] Filed: Jul. 19, 1995

[51] Int. Cl.[6] ..... E05C 5/00

[52] U.S. Cl. ..... 292/113; 292/241; 292/DIG. 49; 292/DIG. 60

[58] Field of Search ..... 292/113, 241, 292/114, DIG. 60, DIG. 49

[56] References Cited

U.S. PATENT DOCUMENTS

| | | | |
|---|---|---|---|
| 1,382,322 | 6/1921 | Schleicher | 292/113 |
| 3,181,905 | 5/1965 | Bisbing . | |
| 3,193,314 | 7/1965 | Johnson . | |
| 4,023,840 | 5/1977 | Souza et al. . | |
| 4,127,305 | 11/1978 | Nielsen . | |
| 4,588,216 | 5/1986 | Hinds . | |
| 4,830,413 | 5/1989 | Bisbing . | |
| 4,915,913 | 4/1990 | Williams et al. . | |
| 4,917,421 | 4/1990 | Wightman et al. . | |
| 4,920,771 | 5/1990 | Jiang . | |
| 5,024,471 | 6/1991 | Kahl et al. . | |
| 5,193,706 | 3/1993 | Hanna et al. . | |
| 5,257,839 | 11/1993 | Nielsen et al. . | |
| 5,351,509 | 10/1994 | Visenzi . | |

FOREIGN PATENT DOCUMENTS

| | | | |
|---|---|---|---|
| 391256 | 12/1973 | U.S.S.R. | 292/113 |

*Primary Examiner*—Rodney M. Lindsey
*Attorney, Agent, or Firm*—Jones, Day, Reavis & Pogue

[57] ABSTRACT

A draw latch assembly is formed of three major components including a base member and a latch or bail member interconnected by a link member. The link member and the base member are capable of being pivotally connected in either of two positions rotated 180° from each other so that the reach of the bail member can selectively be either of two different lengths.

7 Claims, 5 Drawing Sheets

DRAW LATCH ASSEMBLY

BACKGROUND OF THE INVENTION

The subject invention is directed toward the art of draw latch assemblies and, more particularly, to a latch assembly that can be used on a variety of different types and styles of containers.

As is well known, draw type latches are often used for closing and maintaining in a closed position the lids, doors, or access openings of various types of containers or boxes such as tool boxes, electrical housings, storage containers, and the like. The typical draw latch includes a bail or hook member that is connected to a base by a pivotal link that can pivot the bail or hook member from a released to a closed and latched over-center position. Typically, a staple or padlock receiving member is arranged to extend from the base through the bail element to allow a locking of the assembly in its latched position.

As noted, assemblies of the general type under consideration are widely used on a variety of different boxes and containers. Typically, the length of the various elements including the length of the bail or hook member must be changed or designed to fit the needs of the particular box and/or cover being used. Thus, a separate latch assembly must often be provided for each box in a particular manufacturer's line of boxes. Additionally, retrofitting such assemblies to existing box lines produces the same need for different sized latches. Moreover, in those instances where boxes or containers are sold either with or without draw latches, it would be desirable if the same basic box or container could be supplied with a detachable latch assembly that could be purchased separately to the box or container by the ultimate user.

SUMMARY OF THE INVENTION

The subject invention overcomes the noted problems and provides a draw latch assembly that can be quickly modified to vary the reach of the bail or latch member. The components making up the total assembly can be assembled readily in either of two selected options so that the size and effective reach of the bail or latch member is varied between two different sizes to allow the same unit to be used on two different size containers.

In particular, and in accordance with a preferred embodiment of the invention, a draw latch assembly generally comprises a base member having first and second ends with the second end having hinge means associated therewith. Connecting means permit the base member to be selectively connected to the first component such as the base of a box or container with the second end of the base either adjacent or spaced from the second component. A bail member is provided and has a first end generally in the form of a hook for releasable engaged and latched connection with the second component. The bail member also includes a spaced second end. Joined between the second end of the bail member and the second end of the base member is a link member. A first end of the link member is connected to the second end of the bail member and a second end includes means permitting selective connection to the hinge means on the second end of the base member in either of two positions located 180° from each other. This selective connection to the hinge means allows the base member to be positioned with the hinge means either adjacent or significantly spaced from the second component. By so arranging the relationships between the hinged connection of the base member and the link member, a significant change in the reach of the latch or bail member is accomplished.

In accordance with a further aspect of the invention, a staple member extends from the base member and the bail member is provided with two selectively usable openings that allow the hasp staple member to extend therethrough irrespective of which particular connection method is in use between the link member and the base member.

In its preferred form, the base member is joined to the first component by a releasable connection. The various components can be formed as injection molded plastic elements and the means permitting releasable connection of the base member to the first component can be molded in the first component itself if desired.

Preferably, the hinge means that allow connection of the link member to the base member is arranged such that the components can be releasably snapped together in either of the two selected positions. Thus, the entire assembly can be installed or removed from the associated box or container without the need for any tools.

As can be seen from the foregoing, a primary object of the invention is the provision of a latch assembly which can be readily adapted to containers of different sizes and types.

A further object of the invention is the provision of a draw latch assembly of the type described which can be formed from molded plastic components and assembled without the use of tools.

A further object of the invention is the provision of a latch assembly of the type described which is pleasing in appearance and easy to use in either of its alternate conformations.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
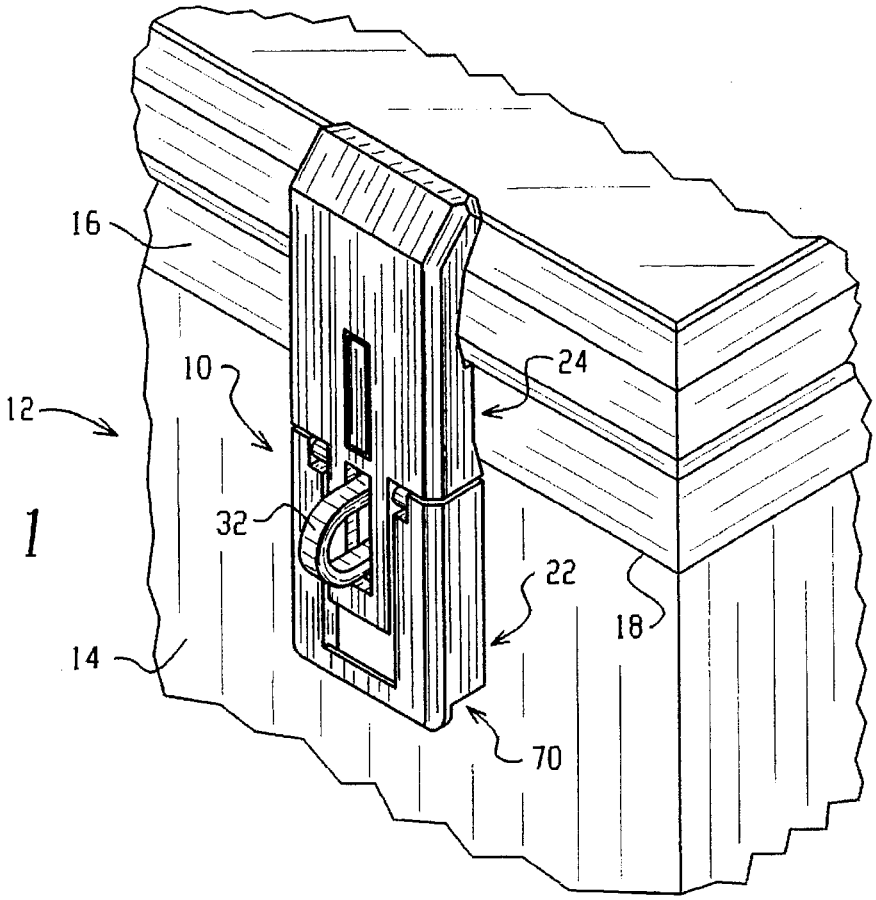
FIG. 1 is an isometric view of a portion of a lidded box structure provided with a draw latch assembly formed in accordance with the preferred embodiment of the invention.
Figure 3:
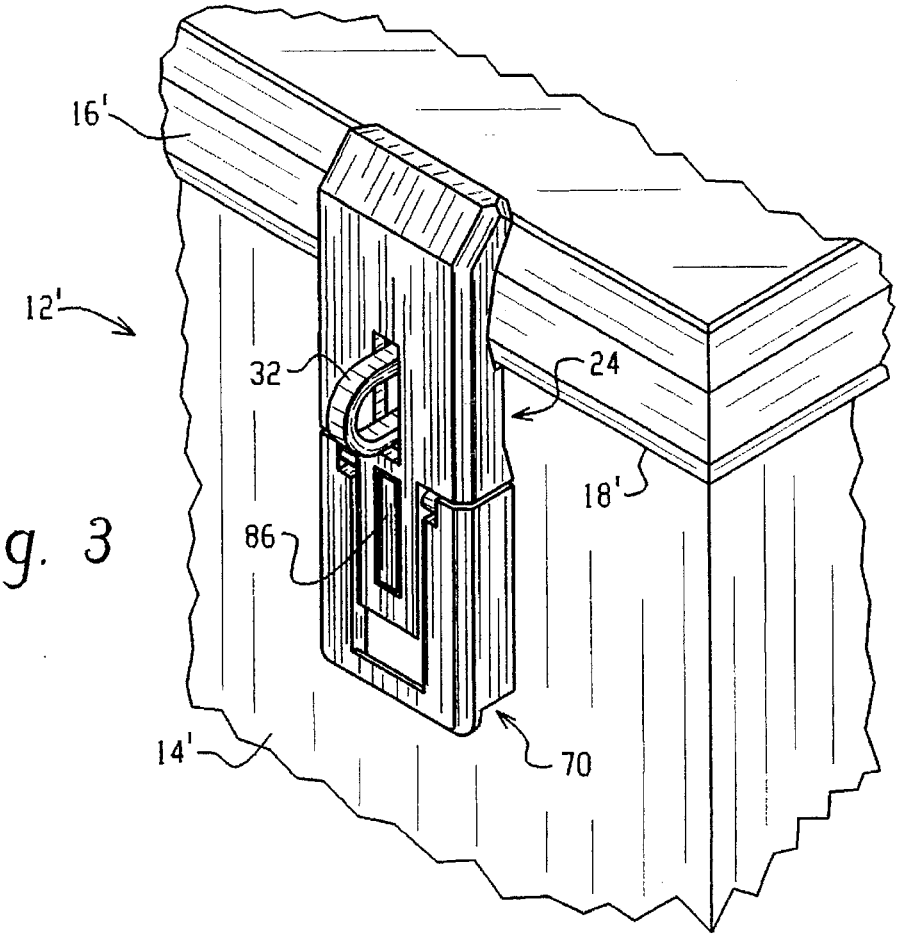
FIG. 3 is a view like FIG. 1 but showing the draw latch assembly as applied to a slightly modified box structure.
Figure 4:
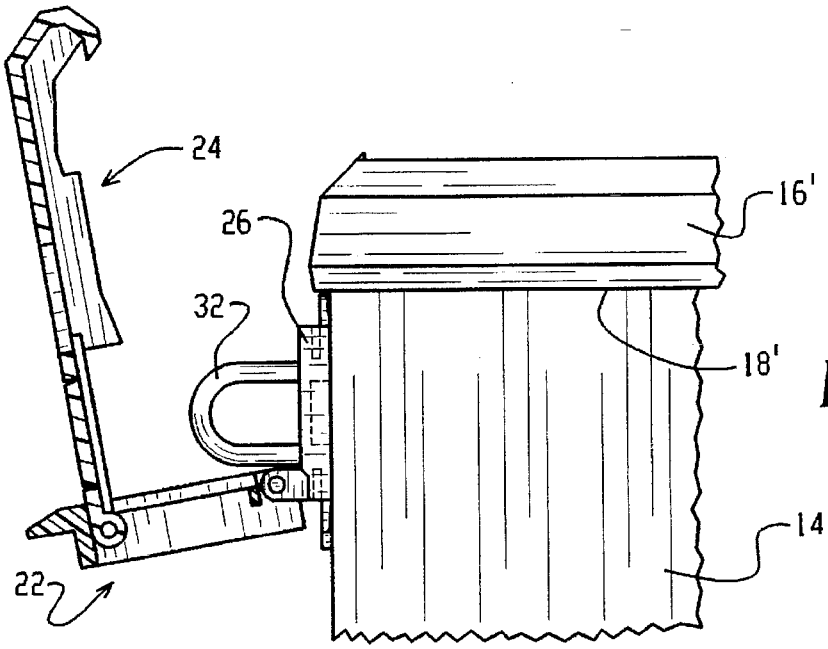
FIG. 4 is a view of the FIG. 3 embodiment with the latch structure shown partially in cross section and in a partially opened or released position.

Referring now to the drawings wherein the showings are for the purposes of illustrating the preferred embodiment of the invention only and not for purposes of limiting same, FIGS. 1 and 3 show the use and arrangement of the improved latch assembly 10 applied and mounted on containers or boxes 12, 12' respectively comprising a first or base component 14, 14' and a second or top component 16, 16'. The container or box assemblies 12, 12' could be of any of a wide variety of types and could have configurations other than those shown. In the subject embodiment, however, the bases or bottom portions 14, 14' have the covers or top sections 16, 16' suitably hinged thereto to open along the upper or top edges 18, 18'.

The draw latch assembly 10 is positioned and arranged so as to function to hold the tops 16, top sections 16' in the closed and latched position shown in FIGS. 1 and 3. It is important to note and understand that the latch assembly 10 uses the same components in both the FIG. 1 and the FIG. 3 embodiment. In the FIG. 3 embodiment, however, the components are assembled in a manner that permits the reach of the latch or bail element to be greater than it is in the FIG. 1 embodiment. This is illustrated by the greater distance between the top of cover 16' and edge 18' in FIG. 3 as compared to the top of cover 16 and edge 18 of the FIG. 1 shown.

Figure 2:
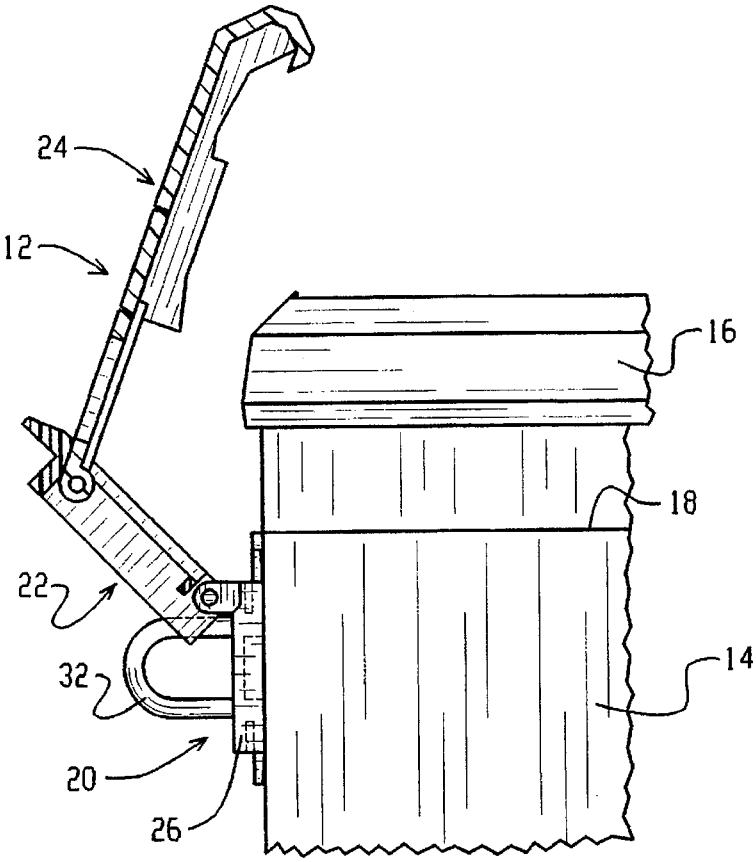
FIG. 2 is a side elevational view, partially in section, showing the latch assembly and box structure of FIG. 1 with the latch element in a partially released position.

To understand the arrangement of the latch assembly 10 and the manner in which it can be adapted to either the FIG. 1 or FIG. 3 embodiment, attention is directed to FIGS. 1 and 2. As shown therein, the latch assembly 10 generally comprises a base member 20 which is releasably connected to the first component 14 in a manner subsequently to be described in some detail. Joined to the base member is a link member 22 which functions to join the bail member 24 to the member 20 and allow the necessary swinging and pivotal movement to move the bail member from the open or released positioned position shown in FIG. 2 to a closed and latched position shown in FIG. 1.

Figure 9:
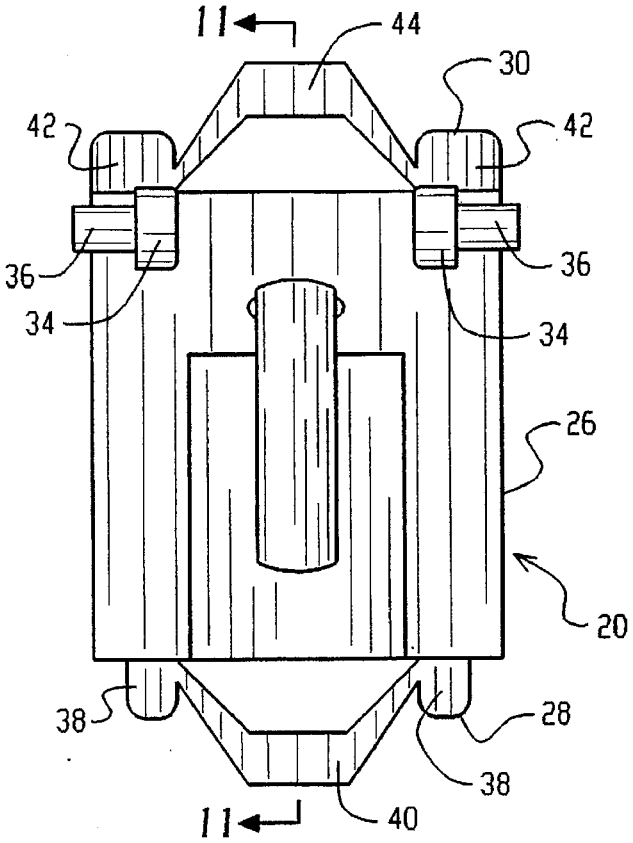
FIG. 9 is a front elevational view of the base member of the latch assembly.
Figure 10:
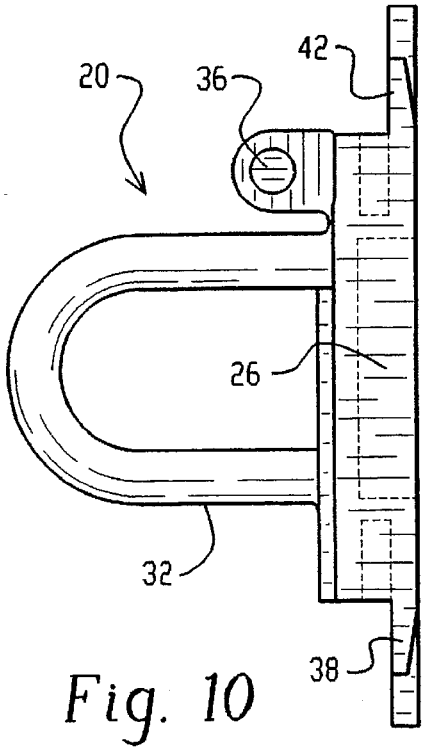
FIG. 10 is a side elevational view of the base member shown in FIG. 9.
Figure 11:
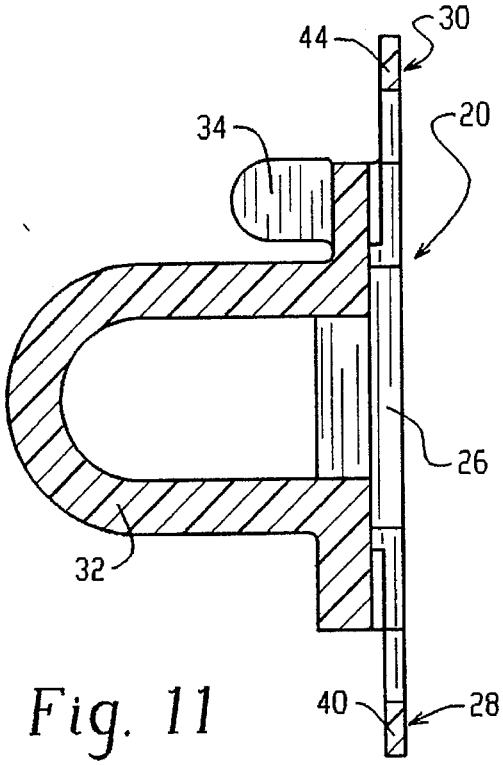
FIG. 11 is cross-sectional view taken on line 11—11 of FIG. 9.

Referring to FIGS. 9 through 11, the base member 20 is shown as generally comprising a rigid, elongated body 26 having a first end 28 and second end 30. Any suitable, comparatively rigid and high strength material could be used for forming the base member 20. In the subject embodiment, however, the base member 20 is formed from plastic using well-known injection molding techniques. The body 26 is generally rectangular and is provided with an outwardly extending U-shaped staple member or element 32 that can function to receive a padlock or similar device for maintaining the draw latch assembly in a closed, locked position.

At its second end 30, the base member 20 is provided with hinge means in the form of outwardly extending rigid support posts 34 and laterally extending cylindrical stubs 36 or pins.

Figure 13:
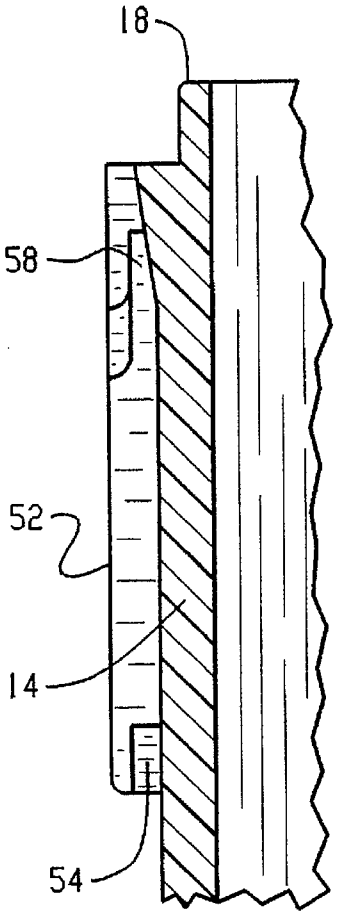
FIG. 13 is a view taken on line 13—13 of FIG. 12.
Figure 12:
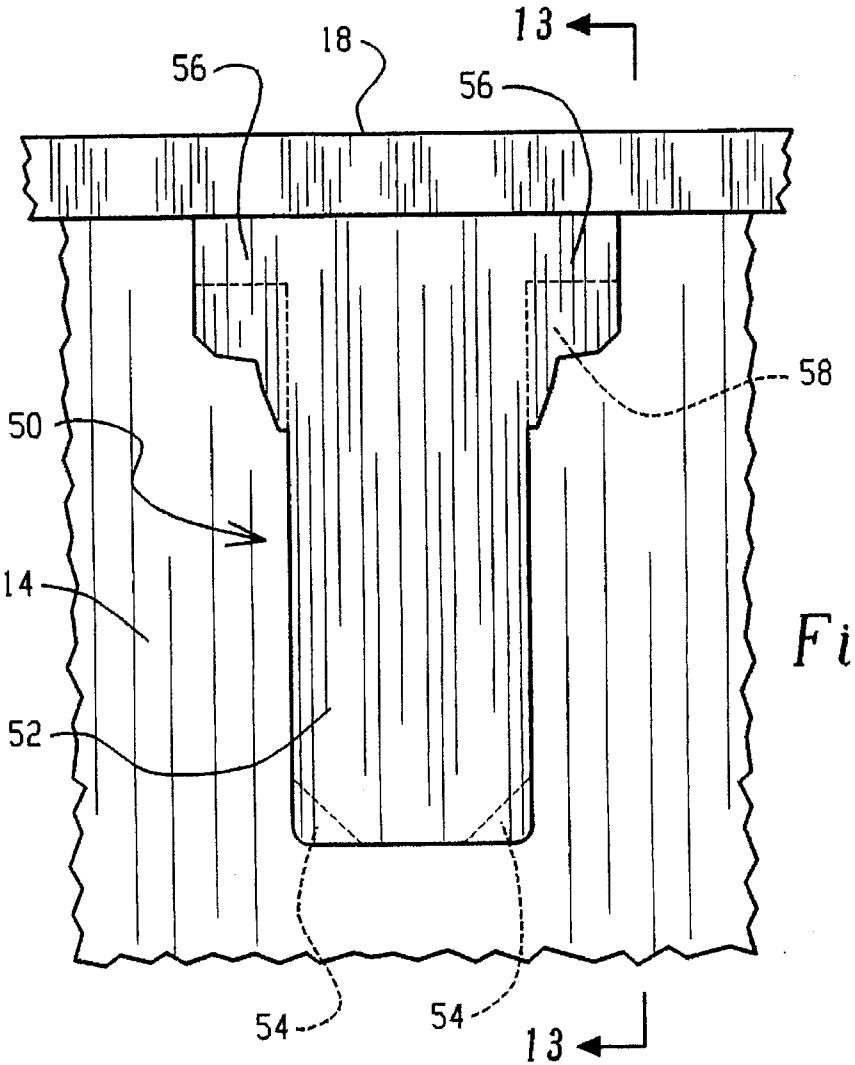
FIG. 12 is a front view of the receiver or connecting components that attach the base element of FIG. 9 to the associated box component.

The ends portions 28, 30 of the base member 20 are of closely similar construction. The end 28 comprises a pair of outwardly extending side portions or pieces 38 that have a longitudinally or wedge-like shape best seen in FIG. 10. Joined between the side pieces 38 is a U-shaped section or portion 40. As noted, the end 30 is closely similar and comprises a pair of spaced side portions 42 which also have a tapered or wedge shape as shown in FIG. 10. A loop element or portion 44 joins between the side portion or pieces 42 as illustrated in FIG. 9. These end structures provide means for allowing releasable connection of the base member 20 to the container component 14. In particular, as shown in FIGS. 12–13, the container component 14 is provided with an integral connecting element or means 50 which is preferably molded directly with component 14 and is designed to slidably receive and retain the base member in a desired position relative thereto. In particular, the connecting means 50 includes a raised center portion 52 that extends outwardly from the outer surface of component 14 and has a generally rectangular elongated configuration of a width so as to be slidably received in the groove 26*a* formed in the rear or back side of the base member 20. The lower end of raised portion 52 is provided with angularly shaped slots or recesses 54 formed at the lower end. These recesses are sized and shaped so that they can engage with and closely receive the connection portions 40 or 44 on the opposite ends of the base member 20.

At the upper end of the portion 52 there are laterally extending sections 56 that include recesses opening 58 which are shaped with a tapered or inclined inner wall adapted to generally correspond to the shape of the side portions 38, 42 located on the ends 28, 30 of the base member 20. As can be appreciated, when the portions 38 or 42 are slid into the opening 58, a frictional engagement and holding of the base member to the component 14 is achieved. The arrangement of the end portion of the base member are such that the base member can be inserted into the engaged position with the element portion 50 from either direction. That is, the hinge means can be either adjacent the upper or lower end. Note, however, that in order to allow the base member to be slid to a mounted position, the therefor portions 40 or 44 on the end that is intended to be uppermost on therefor portion 52 must be removed such as by cutting it loose from its associated side therefor piece 38 or 42, respectively.

As will become apparent hereafter, this ability to reverse the position of the base element allows the same set of components which form the draw latch assembly 10 to be used in different environments by allowing the maximum extension of the bail member 24 to be varied between two different points.

Figure 7:
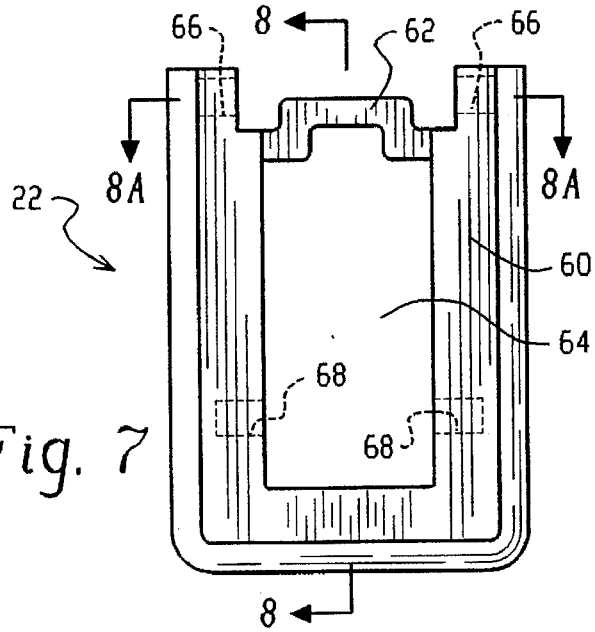
FIG. 7 is a front elevational view of a link member, used in the improved draw latch assembly.
Figure 8:
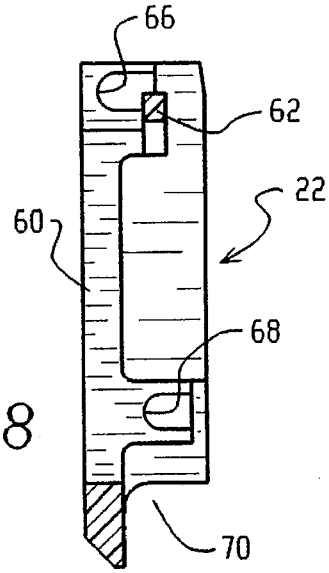
FIG. 8 is a cross-sectional view of the link member shown in FIG. 7 (the view is taken on line 8—8)
Figure 8A:
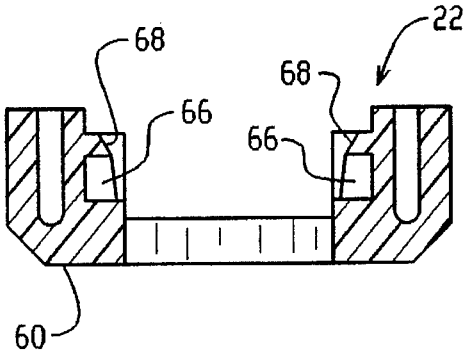
FIG. 8A is a view taken on line 8A—8A of FIG. 7.

Continuing with the description of the major components of the subject draw latch assembly, attention is directed to FIGS. 7, 8, and 8A which illustrate the link member 22 that functions to pivotally join at its opposite ends to the base member 20 and the bail member 24. The link member 22 is formed as an injection molded plastic component, but it could be formed using other materials and techniques. FIG. 7 is a plan view of the link member 22 and shows it as having a generally U-shaped main body 60 joined at the upper end by a transversely extending connector member 62. The open central area 64 is sized so as to be capable of receiving the lower end of the bail member 24 in a manner subsequently to be described. At the upper or first end of the link member 22, there are provided opposed U-shaped or openings 66 (see FIGS. 8 and 8A) that are arranged to function as connecting openings for pivotally joining with the bail member in a manner to be described. As seen in FIG. 8A, the resilient openings 66 are tapered as shown at 68 so as to allow the cooperating pivot pins of the bail member to be received or moved therein. At the second end of the member 22, there are additional resilient recesses or slots 68 formed to provide a pivot connection with the previously-mentioned pins 36 of the base member 20. These openings are likewise arranged so as to be capable of being snapped into position and locking engagement with the pins 36. The bottom or second end of the link member is relieved as shown at 70 so that when in a closed position as shown in FIG. 1, there is a gap or space between the lower end of the connecting link member 22 and the associated component 14 so that the user's fingers can be inserted therein to operate the latch assembly to an open position.

Figure 5:
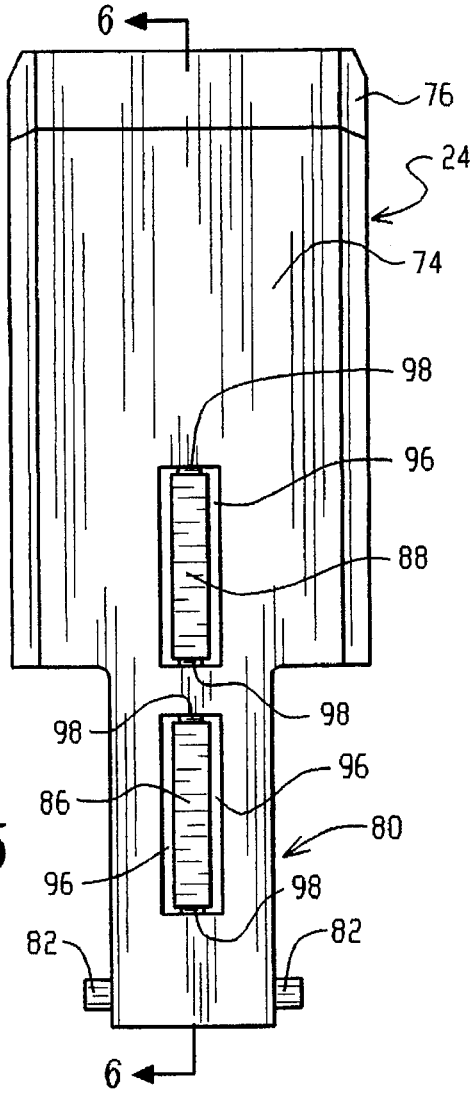
FIG. 5 is a front view of the bail member used in the draw latch assembly.
Figure 6:
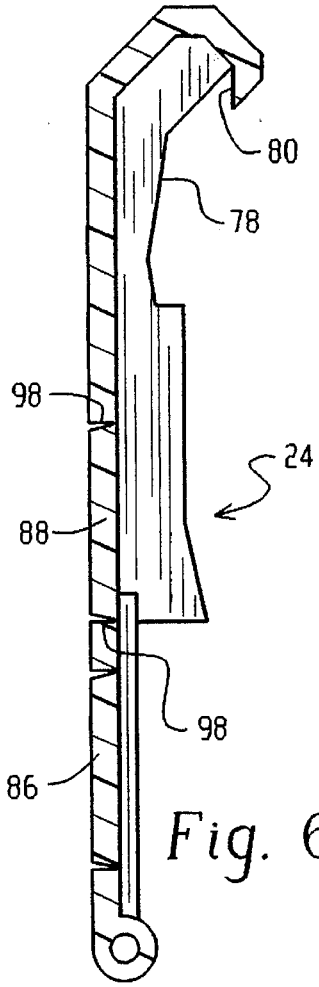
FIG. 6 is a cross-sectional view of the bail member of FIG. 5 (the view is taken on line 6—6 of FIG. 5)

The bail member is best illustrated in FIGS. 5 and 6. It comprises an elongated molded plastic body 74 terminating in a hook-like first end 76. The end End 76 includes a recessed portion 78 and an overlying hook or connector end portion 80. The recessed portion 78 and the related hook portion 80 are configured to the side or cross-sectional shape of the component 16 so that they can engage with and retain the component 16 when the draw latch assembly is in the closed position of FIG. 1.

The second lower end of the bail member 24 is of reduced width and is sized so as to be received within the previously-mentioned open area 64 of the link member 22. Additionally, the lower end 84 is provided with laterally extending, cylindrical elements 82 that are sized so as to be receivable in latched but rotatable relationship in the previously-mentioned recesses 68 formed in the lower end of link member 22.

In order to allow the draw latch assembly to be moved to the full latched position shown in FIG. 1, the element bail member 24 must be provided with an opening through which the staple member 32 can extend as illustrated. For this reason, and considering the dual function nature of the assembly, the body 74 is provided with a pair of generally rectangular shaped knockouts 86 and 88, respectively. Each of the knockouts or openings 86, 88 are formed by a continuous circumferential groove 96 which has end portions 98 that maintain the central rectangular box section in position. However, when desired, the end portions 98 can be cut and the rectangular center section removed to provide the necessary opening. The section of the openings location is, of course, dictated by the particular form, i.e., FIG. 1 or FIG. 3, into which the components are to be assembled.

As can be appreciated, the effective overall appearance of the assembly is little changed between the FIG. 1 and FIG. 3 embodiments. That is, the basic external appearance of the FIG. 1 embodiment is little changed from the FIG. 3 embodiment even though the effective reach of the bail member changes significantly between the two embodiments.

As can be seen from the foregoing, the subject invention allows the same basic latch member to be used on two different sized containers or on containers having differing lid or cover arrangements. Thus, the number of components which must be maintained in the inventory for providing latch closure containers is significantly reduced.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A draw latch assembly for releasably connecting first and second components comprising:

a base member having first and second ends with said second end having a hinge formed integrally therewith;

a connecting element for permitting the base member to be selectively connected to the first component, wherein the base member is alternatively connectable to the connecting member in either of two positions so that the second end of the base member is respectively either adjacent or spaced from the connected location of the second component;

a bail member having a first end for releasable connection to the second component and a spaced second end;

a link member having a first end pivotally connected to the second end of the bail member and a second end including cooperating means permitting selective connection to the hinge on the second end of the base member in said respective either of two positions.

2. The draw latch assembly as defined in claim 1 wherein the base member has a staple element extending outwardly thereof at a location generally midway between its first and second ends.

3. The draw latch assembly as defined in claim 2 wherein the bail member includes an opening through which the staple element extends when the first end of the bail member is in a connected position with the second component.

4. The draw latch assembly as defined in claim 2 wherein the bail member includes two selectively usable openings through which the staple element can extend when the first end of the bail member is in a connected position with the second component, said two openings being positioned to be selectively usable depending upon which one of the said two positions the link member is connected in.

5. The draw latch assembly as defined in claim 1 wherein the base member, the link member, and the bail member are formed of a plastics material.

6. The draw latch assembly as defined in claim 1 wherein the base member includes selectively usable releasable connection means associated with the first and second ends.

7. The draw latch assembly as defined in claim 4 wherein the hinge means includes pivot pins that snap into resilient slots.

* * * * *